United States Patent [19]

Mochida

[11] Patent Number: 4,488,056

[45] **Date of Patent: * Dec. 11, 1984**

[54] ELECTRONIC DOOR LOCKING SYSTEM FOR AN AUTOMOTIVE VEHICLE

[75] Inventor: Haruo Mochida, Kiyokawa, Japan

[73] Assignee: Nissan Motor Company, Limited, Japan

[ * ] Notice: The portion of the term of this patent subsequent to Jan. 24, 2001 has been disclaimed.

[21] Appl. No.: 442,746

[22] Filed: Nov. 18, 1982

[30] Foreign Application Priority Data

Jan. 14, 1982 [JP] Japan ..... 57-3324

[51] Int. Cl.[3] ..... H01H 47/00

[52] U.S. Cl. ..... 307/10 AT; 361/172; 340/825.31; 340/825.32; 180/289

[58] Field of Search ..... 307/10 R, 10 AT; 361/172; 340/543, 825.31, 825.32, 64; 180/286, 289

[56] References Cited

U.S. PATENT DOCUMENTS

| | | | |
|---|---|---|---|
| 3,697,943 | 10/1972 | Andres | 180/286 X |
| 4,205,325 | 5/1980 | Hoygood et al. | 307/10 R X |
| 4,232,354 | 11/1980 | Mueller et al. | 361/172 |
| 4,233,642 | 11/1980 | Ellsberg | 361/172 |
| 4,240,516 | 12/1980 | Henderson et al. | 307/10 AT X |
| 4,332,305 | 6/1982 | Kocolowski | 180/286 X |
| 4,413,261 | 11/1983 | Greenberg | 307/10 AT X |
| 4,419,712 | 12/1983 | Shimizu et al. | 307/10 AT X |
| 4,425,597 | 1/1984 | Schramm | 307/10 AT X |
| 4,428,024 | 1/1984 | Mochida et al. | 307/10 AT X |
| 4,437,137 | 3/1984 | Mochida | 307/10 AT X |
| 4,437,153 | 3/1984 | Kamiyama et al. | 307/10 AT |

*Primary Examiner*—A. D. Pellinen
*Assistant Examiner*—Derek Jennings
*Attorney, Agent, or Firm*—Lowe, King, Price & Becker

[57] ABSTRACT

An electronic door locking system for an automotive vehicle which locks the vehicle doors when the driver depresses push-button type switches installed at an appropriate position on the outside of an automotive vehicle in accordance with a predetermined code, only after the vehicle has been kept parked in a safe state, e.g. after all the vehicle doors have been closed perfectly and/or when the parking brake has been applied to the vehicle securely or the gear shift lever has been set to Park position securely. The system according to the present invention comprises, in particular, a device for detecting unsafe-park states and another device for disabling the lock command signal in response to the unsafe-park signal from the detecting device, in addition to the conventional electronic door locking system.

13 Claims, 1 Drawing Figure

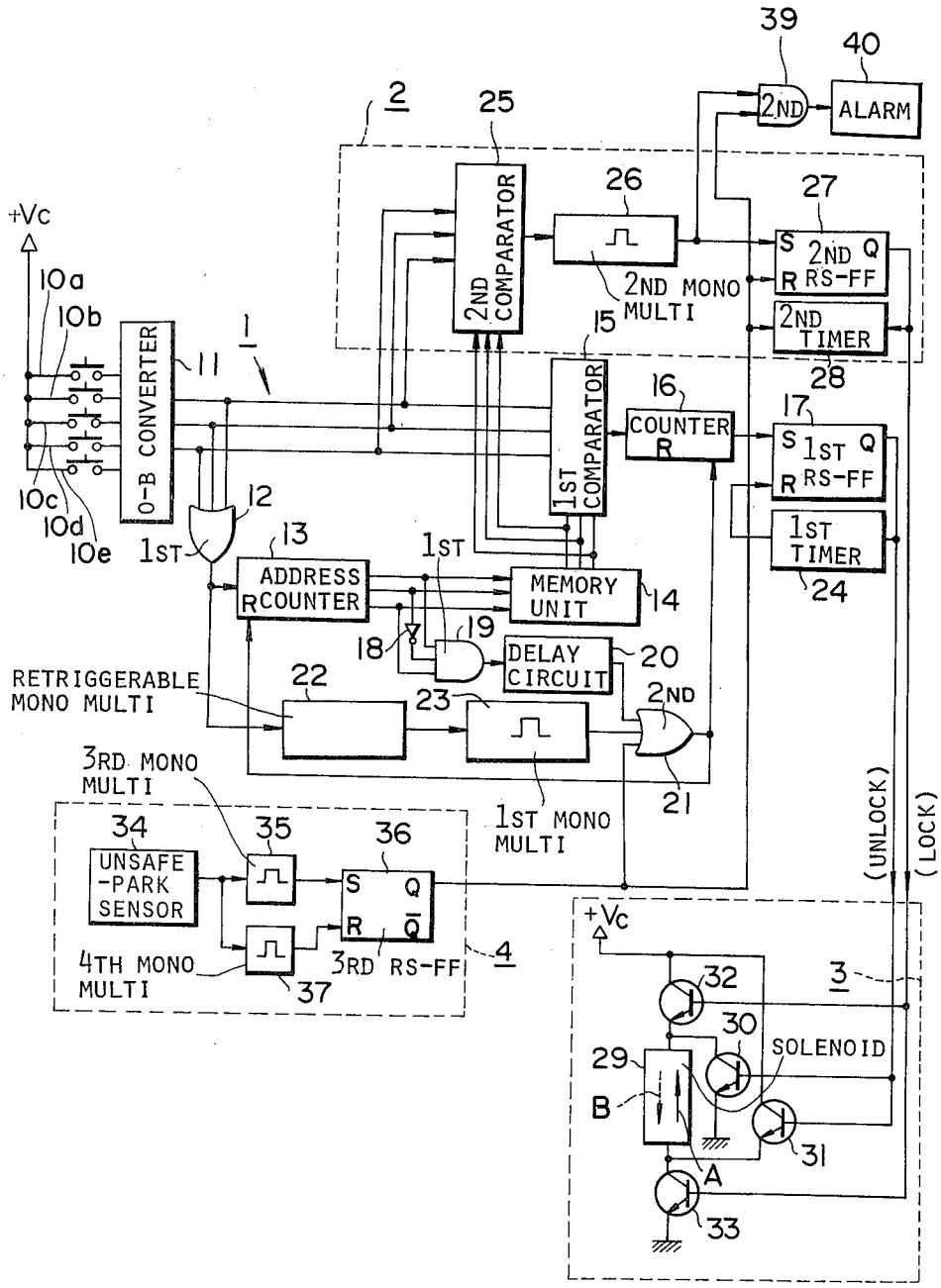
+Vc
10a
10b
10c
10d
10e
0-B CONVERTER
11
1
12
1ST
13
ADDRESS COUNTER
R
1ST
MEMORY UNIT
14
18
19
DELAY CIRCUIT
20
RETRIGGERABLE MONO MULTI
22
23
2ND
21
1ST MONO MULTI
2
25
2ND COMPARATOR
26
2ND MONO MULTI
27
S 2ND Q
R RS-FF
2ND TIMER
28
15
1ST COMPARATOR
16
COUNTER R
17
S 1ST Q
R RS-FF
1ST TIMER
24
39
2ND
40
ALARM
3RD MONO MULTI
34
UNSAFE -PARK SENSOR
35
36
S Q
R Q̄
3RD RS-FF
4
4TH MONO MULTI
37
(UNLOCK)
(LOCK)
+Vc
3
32
30
SOLENOID
29
B
31
A
33

ELECTRONIC DOOR LOCKING SYSTEM FOR AN AUTOMOTIVE VEHICLE

BACKGROUND OF THE INVENTION

1. Field of the Invention

The present invention relates generally to an electronic push-button type door locking device for an automotive vehicle, and more particularly to an electronic door locking system by which vehicle doors can be locked or unlocked when the driver depresses a plurality of push-button type switches in accordance with a predetermined code.

2. Description of the Prior Art

The background of the present invention will be explained with respect to its application to the system used with an automotive vehicle.

As is well-known, there exists an electronic push-button type door locking system for an automotive vehicle, by which vehicle doors can be locked or unlocked when the driver depresses a plurality of push-button type switches installed at an appropriate position on the outside of an automotive vehicle in accordance with a predetermined code. When such an electronic vehicle door locking system as desccribed above is used to lock or unlock the doors, it is very convenient for the driver since the vehicle doors can be locked or unlocked by the driver without using the ignition key, in particular, when the vehicle is left parked.

In the above-mentioned electronic door locking system, however, there exists the danger that the doors will always be locked whenever the driver depresses the push-button type switches, even when the vehicle is left parked in a dangerous situation, for instance, such as when one of the vehicle doors is not closed perfectly or when the parking brake is not applied (when the gear shift lever is not set to Park position securely in the case of an automatic transmission type vehicle). In the case where the driver depresses the push-button switches to lock the vehicle doors with any one of the doors not closed perfectly, the door may be unlocked when the imperfectly-closed door is forcedly pushed inwardly; in the case where the vehicle is left parked without applying parking brake, the vehicle may move into an accident.

Further, in this connection, there exist some vehicles provided with indicator lights for warning that the doors are not closed perfectly or that the parking brake is not applied. However, in some cases, these lights do not come on when the ignition key is turned off or is not in the keyhole. Furthermore, although it is possible to check that all the vehicle doors are closed perfectly in dependence upon the fact that a light for lighting the passenger compartment is left turned on, there exists a danger that the driver may fail to notice it during the daytime.

SUMMARY OF THE INVENTION

With these problems in mind, therefore, it is the primary object of the present invention to provide an electronic door locking system for an automotive vehicle by which the vehicle doors can be locked by depressing one of a plurality of push-button switches only after the vehicle has been kept parked in a safe state; that is, when all the vehicle doors have been closed perfectly and/or when the parking brake has been applied to the vehicle securely or when the gear shift lever has been securely set to the park position.

Therefore, in the electronic door locking system according to the present invention, even if the driver depresses one of the push-button switches to lock the doors, when the vehicle is kept parked in an unsafe state, the vehicle doors will not be locked, thus preventing the vehicle from being stolen or involved in an unexpected accident.

To achieve the above-mentioned object, the electronic door locking system for an automotive vehicle according to the present invention comprises, in particular, means for disabling a door locking command signal when the vehicle is left parked in an unsafe state; that is, when the vehicle is left parked without closing all the doors perfectly or without applying parking brake securely, in addition to the conventional electronic door locking system including a plurality of push-button switches, an octal-binary code converter, an address counter, a memory unit, comparators, a counter, reset-set flip-flops, etc.

BRIEF DESCRIPTION OF THE DRAWINGS

The features and advantages of the electronic door locking system for an automotive vehicle according to the present invention will be more clearly appreciated from the following description of the preferred embodiment of the invention taken in conjunction with the accompanying drawing in which;

The FIGURE is a schematic block diagram of an embodiment of the electronic door locking system according to the present invention.

DETAILED DESCRIPTION OF THE PREFERRED EMBODIMENTS

First, the circuit configuration of an embodiment of the electronic door locking system according to the present invention will be described hereinbelow with reference to the attached drawing.

The system according to the present invention can roughly be divided into four sections: a door unlocking command signal generating section 1, a door locking command signal generating section 2, a door lock/unlock actuating section 3, and an unsafe-park sensor section 4 closely related to the present invention.

In the door unlocking command signal generating section 1, the reference numerals 10*a*–10*e* denote a plurality of push-button type switches arranged at an appropriate position on the outer surface of a vehicle door. To unlock vehicle doors, a specific sequence of numerals, such as the five digits "2-1-3-5-4" are used; while to lock the vehicle doors, a single specific numeral, such as the digit "2" (the first of the above five digits) is used. The reference numeral 11 denotes an octal-binary code converter (referred to as O-B converter hereinafter) for converting the octal code designated by the push-button switches 10*a*–10*e* into the corresponding three-bit binary code. The reference numeral 12 denotes a first OR gate for generating a H-voltage level output signal whenever the O-B converter 11 outputs a three-bit binary coded signal, and the reference numeral 13 denotes an address counter for generating an address-designating signal which is advanced incrementally by the H-voltage level signals from the OR gate 12.

In other words, when a first signal is inputted to the address counter 13 via the first OR gate 12, the counter 13 outputs a three-bit binary signal "001" to designate address No. 1 in the memory unit 14; when a second signal is inputted to the address counter 13 via the first OR gate 12, the counter 13 outputs a three-bit binary signal "010" to designate address No. 2 in the memory unit, and so on.

The reference numeral 14 denotes a memory unit such as a RAM or ROM in which the above-mentioned numerical code "2-1-3-5-4" is previously stored in the form of binary coded digits. The respective binary coded digits corresponding to the above-mentioned octal code "2-1-3-5-4" are read out sequentially in response to the address-designation signals outputted from the address counter 13. The reference numeral 15 denotes a first comparator for comparing the binary coded digits outputted from the O-B converter 11 with the ones read out from the memory unit 14 and outputting a H-voltage level signal whenever the digits agree, the reference numeral 16 denotes a counter for outputting a signal after the first comparator 15 has inputted the predetermined number of signals (five signals in this embodiment) consecutively thereto, and the reference numeral 17 denotes a first reset-set flip-flop (referred to as RS-FF hereinafter) for generating a door unlocking command signal when set by the output signal from the counter 16.

Further, the reference numeral 18 denotes an inverter, the reference numeral 19 denotes a first AND gate, the reference numeral 20 denotes a delay circuit, and the reference numeral 21 denotes a second OR gate. These elements serve to reset the counter 16 to a L-voltage level a fixed period of time after the predetermined octal unlocking code "2-1-3-5-4" has been inputted to the O-B converter 11 by the driver via the push-button switches 10*a*–10*e*.

In more details since the three-bit address signals from the address counter 13 are applied to the respective input terminals of the first AND gate 19, when the last digit of the octal unlocking code is inputted, the address counter 13 outputs a three-bit binary signal "101" (5 in octal code) to designate address No. 5 in the memory unit 14. Therefore, since this three-bit signal is inputted to the first AND gate 19 via the three independent input terminals, the first AND gate 19 outputs a H-voltage level signal, because "0" of the 2nd input terminal is applied to the first AND gate 19 after having been inverted into "1" through the inverter 18. This H-voltage level output signal from the first AND gate 19 is inputted to the delay circuit 20, and, after a fixed period has elapsed, the output signal from the delay circuit 20 resets the counter 16 through the second OR gate 21.

Furthermore, the reference numeral 22 denotes a retriggerable monostable multivibrator which can be retriggered when a H-voltage level signal is inputted thereto within a predetermined period of time but automatically reset to a L-voltage level when no H-voltage level signal is inputted thereto within a predetermined period of time. The reference numeral 23 denotes a first monostable multivibrator which is automatically reset to a L-voltage level after a H-voltage level is kept for a predetermined period of time when triggered. These elements serve to reset the counter 16 to a L-voltage level when the push-button switches are not depressed consecutively, that is, when the switches are depressed intermittently with delays exceeding a predetermined time interval. If the counter 16 is reset before outputting a signal, the first RS-FF will not be set and so will not output a door unlocking signal. In more detail, the output signal from the first OR gate 12 is applied to the retriggerable monostable multivibrator 22 and the first monostable multivibrator 23 is so designed as to be triggered by the trailing edge of the output signal from the retriggerable monostable multivibrator 22. Therefore, in the case where the O-B converter 11 outputs binary coded signals consecutively to the trigger terminal of the retriggerable monostable multivibrator 22, the multivibrator 22 is repeatedly triggered to a H-voltage level without dropping to the L-voltage level as long as the binary coded signals are inputted, therefore, the first monostable multivibrator 23 is not triggered into a H-voltage level (because the first multivibrator 23 can be triggered only when the retriggerable multivibrator 22 changes to a L-voltage level), so that the counter 16 is not reset through the second OR gate 21. In the case where the O-B converter 11 outputs binary coded signals to the trigger terminal of the retriggerable monostable multivibrator 22 intermittently with delays exceeding a predetermined time interval (determined by setting a time constant of the CR circuit in the multivibrator 22), since the retriggerable monostable multivibrator 22 is automatically reset to a L-voltage level before the next binary coded signal from the first OR gate 12 triggers it, the trailing edge of the output signal therefrom triggers the first monostable multivibrator 23, and as a result the counter 16 is reset via the second OR gate 21 to the original condition before it can output a H-level signal to the first RS-FF 17.

Furthermore, after being set, the first RS-FF 17 for outputting a door unlocking signal is reset after a predetermined period of time by an output signal from a first timer 24 which starts in response to the H-voltage level output signal from the first RS-FF 17.

In the door locking command signal generating section 2, the reference numeral 25 denotes a second comparator, the reference numeral 26 denotes a second monostable multivibrator, and the reference numeral 27 denotes a second RS-FF.

To lock the vehicle doors, for instance, the first digit "2" of the five consecutive unlocking numerals "2-1-3-5-4" is depressed by the driver via one of the push-button switches 10*a*–10*e*.

When a push-button switch corresponding to "2" is depressed, the O-B converter 11 outputs the corresponding binary coded signals "010". When this first signal is inputted to the address counter 13 via the first OR gate 12, the counter 13 outputs a three-bit binary signal "001" to designate address No. 1 in the memory unit 14. Therefore, a first stored code signal is read out from the memory unit 14 and this signal is compared with the output signal from the O-B converter 11 by the second comparator 25. When the signals agree, the output signal from the comparator 25 triggers the second monostable multivibrator 26. As a result, the second RS-FF 27 is set by the output signal from the second monostable multivibrator 26, in order to generate a door locking signal. After being set, the second RS-FF 27 for outputting a door locking signal is reset after a predetermined period of time by an output signal from a second timer 28 which starts in response to the H-voltage level output signal from the second RS-FF 27.

In the door lock/unlock actuating section 3, the reference numeral 29 denotes a solenoid and the reference numerals 30–33 denote transistors configuring a switching circuit.

The solenoid 29 is used for locking or unlocking the vehicle doors according to the direction of current flowing therethrough. In more detail, in the case where the first RS-FF 17 outputs a door unlocking command signal, since current is applied to the base of the first transistor 30, the first transistor 30 is turned on. In addition, since current is also applied to the base of the second transistor 31, the second transistor 31 is turned on so that a solenoid energizing current flows from the positive terminal +Vc, through the second transistor 31, the solenoid 29, and the first transistor 30 to ground in the direction of arrow A, so that the solenoid 29 is energized to unlock the vehicle doors. In the case where the second RS-FF 27 outputs a door locking command signal, since current is applied to the base of the fourth transistor 33, the fourth transistor 33 is turned on. In addition, since current is also applied to the base of the third transistor 32, the third transistor 32 is turned on so that a solenoid energizing current flows from the positive terminal +Vc, through the third transistor 32, the solenoid 29, and the fourth transistor 33 to ground in the direction of arrow B, so that the solenoid 29 is energized to lock the vehicle doors.

In the unsafe-park sensor section 4, the numeral 34 denotes an unsafe-park sensor or unsafe-park detecting means for outputting a H-voltage level signal in the case where the vehicle is left parked in an unsafe state, for instance, such as where a vehicle door is not closed perfectly or where parking brake is not applied to the vehicle. Although not shown in the figures, the unsafe-park sensor may include, for instance, one or more switches one of which is closed when any one of the vehicle doors is not closed perfectly or when the parking brake is not applied perfectly or when the gear shift lever is not securely set to the Park position in an automatic transmission type vehicle. These switches can be used inependently or together by connecting them in parallel.

The reference numeral 35 denotes a third monostable multivibrator, the referance numeral 36 denotes a third RS-FF, and the reference numeral 37 denotes a fourth monostable multivibrator. These elements configures means for disabling the lock command signal.

In the case where the vehicle is not parked safely, the unsafe-park sensor 34 outputs a H-voltage level signal to trigger the third monostable multivibrator 35, therefore, the third RS-FF 36 is set to a H-voltage level output. Since the output terminal Q of this third RS-FF 36 is connected to the reset terminal R of the second RS-FF 27, the RS-FF 27 is compulsorily reset by this signal from the third RS-FF 36, so that the RS-FF 27 cannot output a door locking command signal, even if an appropriate push-button switch is depressed to lock the door, when the vehicle is left in an unsafe state.

The fourth monostable multivibrator 37 is triggered when the vehicle doors are closed perfectly or when the gear shift lever is securely set to the Park position, that is, when the output signal from the unsafe-park sensor 34 returns to a L-voltage level, so that the third RS-FF 36 is reset to prevent outputting a reset signal to the second RS-FF 27, that is, the second RS-FF 27 can now output a door locking command signal if the appropriate push-button switch is depressed.

The reference numeral 39 denotes a second AND gate and the reference numeral 40 denotes an alarm device 40.

In the case where a door lock signal is inputted via the push-button switch 10 when the unsafe-park sensor 34 is outputting a H-voltage level signal, since both the signals from the second monostable multivibrator 26 and from the third RS-FF 36 are applied to the second AND gate 39, the AND gate 39 outputs a signal, so that the alarm device 40 such as a buzzer or chime is activated to indicate to the driver that the vehicle is still in an unsafe state and therefore the door lock is inoperative.

The operation of the electronic door locking system for an automotive vehicle according to the present invention will be described hereinbelow.

In order to unlock the vehicle door, first a sequence of predetermined octal digits (2-1-3-5-4) are inputted by the driver via the switches **10*a*–10*e*; the O-B converter outputs a series of three-bit binary numbers (010-001-011-101-100) corresponding to the octal ones; whenever the O-B converter outputs a three-bit binary signal, the address counter 13 is advanced incrementally via the first OR gate 12 to output an address designation signal from No. 1 to No. 5, respectively; in response to these address-designation signals the memory unit 4 outputs the three-bit binary codes previously stored in the designated memory addresses; these numbers are compared with the ones outputted from the O-B converter by the first comparator 15; if the numbers match, the comparator 15 outputs a H-level signal; after a series of binary unlocking numbers have been successfully compared, the counter 16 outputs a signal to set the first RS-FF 17, so that a door unlocking signal is outputted. Therefore, the transistors 30 and 31 are both turned on in response to the unlocking signal, and current passes through the solenoid 29** in the direction of arrow A to unlock the vehicle doors.

Further, when the last unlocking number is inputted and therefore the address-designation signal No. 5 (101) is outputted from the address counter 13, the counter 16 is reset after a predetermined period of time determined by the delay circuit 20. If the unlocking numbers are inputted intermittently with delays exceeding a predetermined time interval, the counter 16 is also reset through the retriggerable monostable multivibrator 22 and the first monostable multivibrator 23.

In the case where the door is intended to be locked from outside the vehicle by depressing the appropriate push-button switch **10*a*–10*e* when the unsafe-park sensor 34 is outputting a H-voltage level signal, the RS-FF 36 is set by a trigger signal from the monostable multivibrator 35. Therefore, the reset terminal R of the second RS-FF 27 goes to a H-voltage level, that is, to the reset state, compulsorily. As a result, even if the proper push-button switch 10*a*–10*e* is depressed to lock the door, no locking signal will be outputted, disabling door lock operation. At the same time, the H-voltage level output signal for the AND gate 39 actuates the alarm device 40**, indicating to the driver that the vehicle is still in an unsafe state and thereby the doors can not be locked.

Therefore, the driver will notice that the vehicle is left parked unsafely. If the doors are all closed or the parking park is not applied perfectly, the sensor 34 outputs a L-voltage level signal to reset the RS-FF 36.

Under these conditions, when one of the push-button switches **10*a*–10*e* is depressed, binary coded signals are applied from the O-B converter 11 to the second comparator 25; a code stored in the memory unit 14 is read out when the address counter 13 designates address No. 1; the second comparator 25 outputs a signal when the signals match in order to trigger the second monostable multivibrator 26; a locking signal is outputted when the second RS-FF 27 is set. The transistors 32 and 33 are turned on in response to the locking signal, and current passes through the solenoid 29** in the direction of arrow B to lock the vehicle door.

In the door locking operation, although the first comparator 15 also outputs a signal to advance the counter 16, since only one of the push-button switches 10*a*–10*e* has been depressed, the retriggerable multivibrator 22 is reset after a predetermined period of time and the counter 16 is reset, so that the unlocking command signal is not generated.

By the way, in a cold weather, there exists the case where it is preferable not to apply brake force to a vehicle when the vehicle is left parked in the open air for a long time, because the brake lining may be frozen to the brake shoes and will not operate. Under consideration of these cases, it may be desirable to provide a switch which can disable the sensor 34 according to the present invention.

As described above, in the electronic door locking system for an automotive vehicle according to the present invention by which vehicle doors can be locked or unlocked when the drive depress a plurality of push-button type swiches installed at an appropriate position on the outside of an automotive vehicle in accordance with a predetermined code, since the door locking operation is automatically disabled when the vehicle is left parked in an unsafe state, for instance, when a vehicle door is not closed perfectly, when the parking brake is not applied perfectly, or when the gear shift lever is not securely set to the Park position, the doors will be locked only when the vehicle is left parked in a safety state, thus preventing the vehicle from being stolen or from unexpected accident; that is, it being possible to park the vehicle safely.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. An electronic door locking system for an automotive vehicle for locking/unlocking vehicle doors, which comprises:

(a) means for inputting a sequence of unlocking coded numbers and at least one locking coded number and outputting signals corresponding thereto;

(b) means for generating an unlock command signal in response to a sequence of unlocking coded numbers outputted from said means for inputting coded numbers;

(c) means for generating a lock command signal in response to at least one locking coded number signal outputted from said means for inputting coded numbers;

(d) means for unlocking the vehicle doors in response to the unlock command signal outputted from said means for generating an unlock command signal and locking the vehicle doors in response to the lock command signal outputted from said means for generating a lock command signal;

(e) means for detecting that the automotive vehicle is left parked in an unsafe state and outputting an unsafe-park signal; and (f) means for disabling the lock command signal in response to the unsafe-park signal from said detecting means, said disabling means being connected to said means for generating a lock command signal.

2. An electronic door locking system for an automotive vehicle for locking/unlocking vehicle doors, which comprises:

(a) plurality of switches for outputting at least one predetermined door-locking octal coded digit and a sequence of predetermined door-unlocking octal coded digits;

(b) an octal-binary code converter connected to a plurality of said switches for converting the octal coded digits inputted from said switches into corresponding binary coded digits;

(c) an address counter connected to said octal-binary code converter for counting up a number of the binary-coded digits outputted from said octal-binary code converter whenever one of said switches is depressed and outputting an address-designation signal in response to the number of digits outputted from said octal-binary code converter;

(d) a memory unit connected to said address counter for outputting a previously stored binary coded digit in response to the address-designation signal outputted from said address counter;

(e) a first comparator connected to said octal-binary code converter and said memory unit for outputting a signal when one of the binary coded door-unlocking digits outputted from said octal-binary code converter agrees with one of the binary coded door-unlocking digits outputted from said memory unit in response to the respective address-designation signal outputted from said address counter;

(f) a counter connected to said first comparator for outputting a signal when said first comparator outputs said signal thereof;

(g) a first reset-set flip-flop connected to said counter for outputting a door unlocking command signal when said counter outputs the signal thereof;

(h) a second comparator connected to said octal-binary code converter and said memory unit for outputting a signal when at least one binary coded door-locking digit outputted from said octal-binary code converter agrees with at least one binary coded door-locking digit outputted from said memory unit in response to the address designation signal outputted from said address counter;

(i) a second reset-set flip-flop connected to said second comparator for outputting a door locking command signal when said second comparator outputs the signal thereof;

(j) a door lock/unlock actuating solenoid connected to said first and second reset-set flip-flops for unlocking the vehicle doors when said first reset-set flip-flop is set and locking the vehicle doors when said second reset-set flip-flop is set;

(k) means for detecting that the automotive vehicle is left parked in an unsafe state and outputting an unsafe-park signal; and (l) means for disabling the door locking command signal by resetting said second reset-set flip-flop in response to the unsafe-park signal from said detecting means.

3. An electronic door locking system for an automotive vehicle as set forth in claim 2, wherein said means for disabling the door locking command signal comprises:

(a) two monostable multivibrators connected to said detecting means, one of which is triggered when said detecting means outputs a signal and the other of which is triggered when said detecting means outputs no signal; and (b) a third reset-set flip-flop, a set terminal of which is connected to one of said two monostable multivibrators, a reset terminal of which is connected to the other of said two monostable multivibrators, and an otuput terminal of which is connected to a reset terminal of said second reset-set flip-flop, said second reset-set flip-flop being reset when said third reset-set flip-flop outputs a signal, that is, when said detecting means outputs a signal.

4. An electronic door locking system for an automotive vehicle as set forth in claim 3, which further comprises:

(a) an AND gate one input terminal of which is connected to said second comparator and another input terminal of which is connected to said third reset-set flip-flop, said AND gate outputting a signal when said second comparator outputs a signal, that is, at least one predetermined door-locking octal coded digit is inputted to the system via a plurality of said switches and when said third reset-set flip-flop outputs a signal, that is, said detecting means detects that the vehicle is left parked in an unsafe state; and (b) an alarm device connected to the output terminal of said AND gate for producing an alarm in response to the signal from said AND gate.

5. An electronic door locking system for an automotive vehicle as set forth in claim 4 wherein said alarm device comprises audible alarm means.

6. An electronic door locking system for an automotive vehicle as set forth in claim 5, wherein said audible alarm means comprises a buzzer.

7. An electronic door locking system for an automotive vehicle as set forth in claim 5, wherein said audible alarm means comprises a chime.

8. An electronic door locking system for an automotive vehicle for locking/unlocking vehicle doors, which comprises:

(a) means for inputting a sequence of unlocking coded numbers and at least one locking coded number and outputting signals corresponding thereto;

(b) means for generating an unlock command signal in response to a sequence of unlocking coded numbers outputted from said means for inputting coded numbers;

(c) means for generating a lock command signal in response to at least one locking coded number signal outputted from said means for inputting coded numbers;

(d) means for unlocking the vehicle doors in response to the unlock command signal outputted from said means for generating an unlock command signal and locking the vehicle doors in response to the lock command signal outputted from said means for generating a lock command signal;

(e) means for detecting that the automotive vehicle is left parked in an unsafe state and outputting an unsafe-park signal;

(f) means for disabling the lock command signal in response to the unsafe-park signal from said detecting means, said disabling means being connected to said means for generating a lock command signal; and (g) wherein said means for detecting that the vehicle is left parked in an unsafe state comprises a switch closed when any door of the vehicle is not closed perfectly.

9. An electronic door locking system for an automotive vehicle for locking/unlocking vehicle doors, which comprises:

(a) a plurality of switches for outputting at least one predetermined door-locking octal coded digit and a sequence of predetermined door-unlocking octal coded digits;

(b) an octal-binary code converter connected to a plurality of said switches for converting the octal coded digits inputted from said switches into corresponding binary coded digits;

(c) an address counter connected to said octal-binary code converter for counting up a number of the binary-coded digits outputted from said octal-binary code converter whenever one of said switches is depressed and outputting an address-designation signal in response to the number of digits outputted from said octal-binary code converter;

(d) a memory unit connected to said address counter for outputting a previously stored binary coded digit in response to the address-designation signal outputted from said address counter;

(e) a first comparator connected to said octal-binary code converter and said memory unit for outputting a signal when one of the binary coded door-unlocking digits outputted from said octal-binary code converter agrees with one of the binary coded door-unlocking digits outputted from said memory unit in response to the respective address-designation signal outputted from said address counter;

(f) a counter connected to said first comparator for outputting a signal when said first comparator outputs said signal thereof;

(g) a first reset-set flip-flop connected to said counter for outputting a door unlocking command signal when said counter outputs the signal thereof;

(h) a second comparator connected to said octal-binary code converter and said memory unit for outputting a signal when at least one binary coded door-locking digit outputted from said octal-binary code converter agrees with at least one binary coded door-locking digit outputted from said memory unit in response to the address-designation signal outputted from said address counter;

(i) a second reset-set flip-flop connected to said second comparator for outputting a door locking command signal when said second comparator outputs the signal thereof;

(j) a door lock/unlock actuating solenoid connected to said first and second reset-set flip-flops for unlocking the vehicle doors when said first reset-set flip-flop is set and locking the vehicle doors when said second reset-set flip-flop is set;

(k) means for detecting that the automotive vehicle is left parked in an unsafe state and outputting an unsafe-park signal;

(l) means for disabling the door locking command signal by resetting said second reset-set flip-flop in response to the unsafe-park signal from said detecting means; and (m) wherein said means for detecting that the vehicle is left parked in an unsafe state comprises a switch closed when any door of the vehicle is not closed perfectly.

10. An electronic door locking system for an automotive vehicle for locking/unlocking vehicle doors, which comprises:

(a) means for inputting a sequence of unlocking coded numbers and at least one locking coded number and outputting signals corresponding thereto;

(b) means for generating an unlock command signal in response to a sequence of unlocking coded numbers outputted from said means for inputting coded numbers;

(c) means for generating a lock command signal in response to at least one locking coded number signal outputted from said means for inputting coded numbers;

(d) means for unlocking the vehicle doors in response to the unlock command signal outputted from said means for generating an unlock command signal and locking the vehicle doors in response to the lock command signal outputted from said means for generating a lock command signal;

(e) means for detecting that the automotive vehicle is left parked in an unsafe state and outputting an unsafe-park signal;

(f) means for disabling the lock command signal in response to the unsafe-park signal from said detecting means, said disabling means being connected to said means for generating a lock command signal; and (g) wherein said means for detecting that the vehicle is left parked in an unsafe state comprises a switch closed when a parking brake is not securely applied to the vehicle.

11. An electronic door locking system for an automotive vehicle for locking/unlocking vehicle doors, which comprises:

(a) a plurality of switches for outputting at least one predetermined door-locking octal coded digit and a sequence of predetermined door-unlocking octal coded digits;

(b) an octal-binary code converter connected to a plurality of said switches for converting the octal coded digits input from said switches into corresponding binary coded digits;

(c) an address counter connected to said octal-binary code converter for counting up a number of the binary-coded digits output from said octal-binary code converter whenever one of said switches is depressed and outputting an address-designation signal in response to the number of digits outputted from said octal-binary code converter;

(d) a memory unit connected to said address counter for outputting a previously stored binary coded digit in response to the address-designation signal outputted from said address counter;

(e) a first comparator connected to said octal-binary code converter and said memory unit for outputting a signal when one of the binary coded door-unlocking digits outputted from said octal-binary code converter agrees with one of the binary coded door-unlocking digits outputted from said memory unit in response to the respective address-designation signal outputted from said address counter;

(f) a counter connected to said first comparator for outputting a signal when said first comparator outputs said signal thereof;

(g) a first reset-set flip-flop connected to said counter for outputting a door unlocking command signal when said counter outputs the signal thereof;

(h) a second comparator connected to said octal-binary code converter and said memory unit for outputting a signal when at least one binary coded door-locking digit outputted from said octal-binary code converter agrees with at least one binary coded door-locking digit outputted from said memory unit in response to the address-designation signal outputted from said address counter;

(i) a second reset-set flip-flop connected to said second comparator for outputting a door locking command signal when said second comparator outputs the signal thereof;

(j) a door lock/unlock actuating solenoid connected to said first and second reset-set flip-flops for unlocking the vehicle doors when said first reset-set flip-flop is set and locking the vehicle doors when said second reset-set flip-flop is set;

(k) means for detecting that the automotive vehicle is left parked in an unsafe state and outputting an unsafe-park signal;

(l) means for disabling the door locking command signal by resetting said second reset-set flip-flop in response to the unsafe-park signal from said detecting means; and (m) wherein said means for detecting that the vehicle is left parked in an unsafe state comprises a switch closed when a parking brake is not securely applied to the vehicle.

12. An electronic door locking system for an automotive vehicle for locking/unlocking vehicle doors, which comprises:

(a) means for inputting a sequence of unlocking coded numbers and at least one locking coded number and outputting signals corresponding thereto;

(b) means for generating an unlock command signal in response to a sequence of unlocking coded numbers outputted from said means for inputting coded numbers;

(c) means for generating a lock command signal in response to at least one locking coded number signal outputted from said means for inputting coded numbers;

(d) means for unlocking the vehicle doors in response to the unlock command signal outputted from said means for generating an unlock command signal and locking the vehicle doors in response to the lock command signal outputted from said means for generating a lock command signal;

(e) means for detecting that the automotive vehicle is left parked in an unsafe state and outputting an unsafe-park signal;

(f) means for disabling the lock command signal in response to the unsafe-park signal from said detecting means, said disabling means being connected to said means for generating a lock command signal; and (g) wherein said means for detecting that the vehicle is left parked in an unsafe state comprises a switch closed when a gear shift lever is not securely set to park position.

13. An electronic door locking system for an automotive vehicle for locking/unlocking vehicle doors, which comprises:

(a) a plurality of switches for outputting at least one predetermined door-locking octal coded digit and a sequence of predetermined door-unlocking octal coded digits;

(b) an octal-binary code converter connected to a plurality of said switches for converting the octal coded digits inputted from said switches into corresponding binary coded digits;

(c) an address counter connected to said octal-binary code converter for counting up a number of the binary-coded digits outputted from said octal-binary code converter whenever one of said switches is depressed and outputting an address-designation signal in response to the number of digits outputted from said octal-binary code converter;

(d) a memory unit connected to said address counter for outputting a previously stored binary coded digit in response to the adress-designation signal outputted from said address counter;

(e) a first comparator connected to said octal-binary code converter and said memory unit for outputting a signal when one of the binary coded door-unlocking digits outputted from said octal-binary code converter agrees with one of the binary coded door-unlocking digits outputted from said memory unit in response to the respective address-designation signal outputted from said address counter;

(f) a counter connected to said first comparator for outputting a signal when said first comparator outputs said signal thereof;

(g) a first reset-set flip-flop connected to said counter for outputting a door unlocking command signal when said counter outputs the signal thereof;

(h) a second comparator connected to said octal-binary code converter and said memory unit for outputting a signal when at least one binary coded door-locking digit outputted from said octal-binary code converter agrees with at least one binary coded door-locking digit outputted from said memory unit in response to the address-designation signal outputted from said address counter;

(i) a second reset-set flip-flop connected to said second comparator for outputting a door locking command signal when said second comparator outputs the signal thereof;

(j) a door lock/unlock actuating solenoid connected to said first and second reset-set flip-flops for unlocking the vehicle doors when said first reset-set flip-flop is set and locking the vehicle doors when said second reset-set flip-flop is set;

(k) means for detecting that the automotive vehicle is left parked in an unsafe state and outputting an unsafe-park signal;

(l) means for disabling the door locking command signal by resetting said second reset-set flip-flop in response to the unsafe-park signal from said detecting means; and (m) wherein said means for detecting that the vehicle is left parked in an unsafe state comprises a switch closed when a gear shift lever is not securely set to park position.

* * * * *